US007980867B2

(12) United States Patent
Dei Rossi et al.

(10) Patent No.: US 7,980,867 B2
(45) **Date of Patent: *Jul. 19, 2011**

(54) PORTABLE COMPUTER UNIVERSAL SERIAL BUS DEVICE WITH AN EXTENDABLE CONNECTOR SECURED BY MULTIPLE LOCKING MECHANISMS

(75) Inventors: Dwayne Dei Rossi, Irvine, CA (US); George Shiu, South Padadena, CA (US)

(73) Assignee: Kingston Technology Corporation, Fountain Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/792,687

(22) Filed: Jun. 2, 2010

(65) Prior Publication Data

US 2010/0240236 A1 Sep. 23, 2010

Related U.S. Application Data

(63) Continuation of application No. 11/643,302, filed on Dec. 21, 2006, now Pat. No. 7,740,492.

(51) Int. Cl.
*H01R 13/44* (2006.01)

(52) U.S. Cl. ..... 439/131; 439/141

(58) Field of Classification Search ..... 439/131, 439/141, 638, 135

See application file for complete search history.

(56) References Cited

U.S. PATENT DOCUMENTS

| | | | | |
|---|---|---|---|---|
| 6,456,500 | B1 | 9/2002 | Chen | |
| 6,612,853 | B2 | 9/2003 | Wu | |
| 6,676,419 | B1 * | 1/2004 | Lin et al. | 439/76.1 |
| 6,733,328 | B2 * | 5/2004 | Lin et al. | 439/501 |
| 6,743,030 | B2 | 6/2004 | Lin et al. | |
| D494,969 | S | 8/2004 | Lin | |
| 6,792,487 | B2 | 9/2004 | Kao | |
| 6,808,400 | B2 | 10/2004 | Tu | |
| 6,979,210 | B2 | 12/2005 | Regen et al. | |
| 7,004,780 | B1 * | 2/2006 | Wang | 439/353 |
| 7,037,120 | B1 * | 5/2006 | Yeh | 439/131 |
| 7,070,425 | B2 | 7/2006 | Regen et al. | |
| 7,070,427 | B2 * | 7/2006 | Liao et al. | 439/135 |
| 7,407,390 | B1 | 8/2008 | Ni | |
| 7,422,454 | B1 | 9/2008 | Tang et al. | |
| 2006/0240692 | A1 | 10/2006 | Regan et al. | |
| 2006/0258224 | A1 * | 11/2006 | Liao | 439/638 |

* cited by examiner

*Primary Examiner* — Xuong M Chung Trans
(74) *Attorney, Agent, or Firm* — Sawyer Law Group, P.C.

(57) ABSTRACT

An apparatus for use within an electrical devices is disclosed. The apparatus comprises a casing having an upper body and a lower body, the casing including a tab disposed on a surface thereof and an adjustable base having a plurality of tab cavities adjacent to the tab. The tab engagingly couples to one of the plurality of tab cavities to secure the adjustable base. The apparatus also includes a connector system coupled to the adjustable base.

12 Claims, 4 Drawing Sheets

PORTABLE COMPUTER UNIVERSAL SERIAL BUS DEVICE WITH AN EXTENDABLE CONNECTOR SECURED BY MULTIPLE LOCKING MECHANISMS

CROSS-REFERENCE TO RELATED APPLICATIONS

This application is a Continuation of U.S. patent application Ser. No. 11/643,302, entitled Portable Computer Universal Serial Bus Device with an Extendable Connector Secured by Multiple Locking Mechanisms, filed Dec. 21, 2006.

FIELD OF THE INVENTION

The present invention relates generally to a device and more particularly to an extendable connector on such a device.

BACKGROUND OF THE INVENTION

Many efforts have been made to improve the design of electronic devices, such as USB devices. However, many of these designs cause additional problems in the device. For example, U.S. Pat. No. 6,808,400 discloses an USB device that utilizes a latch/clip on one side of a drive and uses spring tension to control the slide movement. Typically, due to metal fatigue, a spring's force diminishes, as the USB device is retracted for an extended length of time, which eventually shortens the productive life span of the device.

U.S. Pat. No. 7,004,780 discloses a new design for an USB device, but requires a user to apply a force to a printed circuit board assembly (PCBA) to release a set of slide locks to enable the sliding motion. It has been observed that applying force to a PCBA results in damage to trace connections.

Accordingly, what is desired is a device that overcomes the aforementioned issues and provides improved performance.

BRIEF SUMMARY OF THE INVENTION

An apparatus for use within electrical devices is disclosed. The apparatus comprises a casing having an upper body and a lower body, the casing including a tab disposed on a surface thereof and an adjustable base having a plurality of tab cavities adjacent to the tab. The tab engagingly couples to one of the plurality of tab cavities to secure the adjustable base. The device also includes a connector system coupled to the adjustable base.

It is an advantage of the present invention to provide an apparatus that includes a casing design that enables a connector system of the device to extend and retract utilizing multiple slide-locking mechanism.

BRIEF DESCRIPTION OF SEVERAL VIEWS OF THE DRAWINGS

The present invention is illustrated by way of example and not limitation in the figures of the accompanying drawings, in which like references indicate similar elements, and in which.

DETAILED DESCRIPTION OF THE INVENTION

The present invention relates generally to a device casing and more particularly to an extendable connector on such a device. The following description is presented to enable one having ordinary skill in the art to make and use the invention and is provided in the context of a patent application and the generic principles and features described herein will be apparent to those skilled in the art. Thus, the present invention is not intended to be limited to the embodiments shown, but is to be accorded the widest scope consistent with the principles and features described herein.

The device of the present invention may be directed to electronic devices such as a USB device as well as various computer peripheral devices that are connected by plug connectors to a host computer system to perform various functions. Accordingly, it will be appreciated that the present invention is applicable to any and all pocket-sized computer peripheral device types that are readily transportable and which may be advantageously interconnected with various host computer systems (i.e. any electronic computer of any type or size including desktop computers, notebook computers, palmtop computers, and personal digital assistant devices). For example, flash memory storage devices, communication devices, scanners, and cameras are all applicable pocket-sized computer peripheral devices to the present invention.

Accordingly, it will be appreciated by one having ordinary skill in the art that the present invention is applicable, in general, to electronic devices and is therefore not limited to USB devices. Therefore, one having ordinary skill in the art will readily recognize that there could be variations to the USB device embodiments and those variations would be within the spirit and scope of the present invention.

Figure 1:
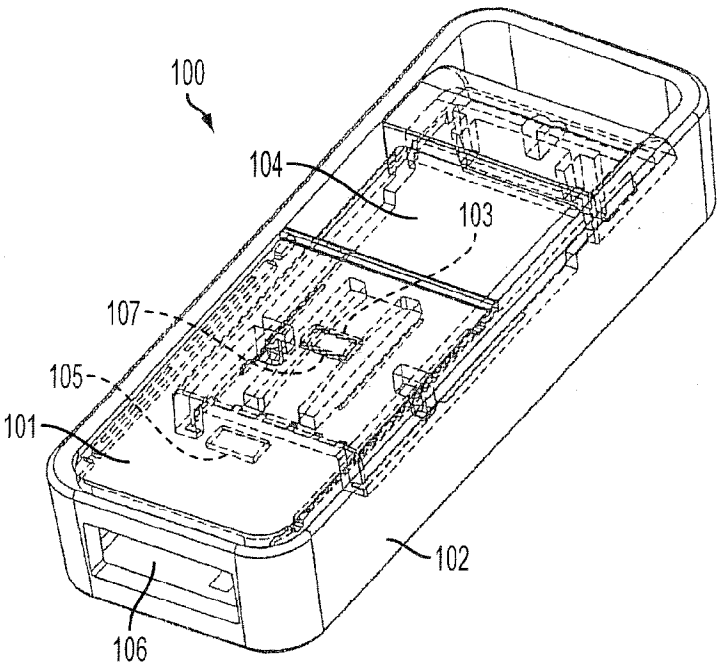
FIG. 1 shows a perspective view of an Universal Serial Bus device with an internal slide mechanism, according to an embodiment.

FIG. 1 shows a perspective view of an Universal Serial Bus device 100 with an internal slide mechanism, according to an embodiment. For an embodiment, Universal Serial Bus device 100 comprises an adjustable base 101, a first casing 102, tab 103, inner surface 104, tab recesses 105/107, connector system 106, and a printed circuit board assembly (not shown). The perspective view of Universal Serial Bus device 100 shows connector system 106 retracted within the first housing casing 102. That is, tab 103 is locked in place by tab recess 107 such that connector system 106 is in the furthest position (according to a design embodiment) within casing 102 (and a set of slot pins locked in place within a set of locking cavities—described in more detail below). For an embodiment, connector system 106 is completely within casing 102 such that connector system 106 is not exposed and the first casing 102 provides protection thereto.

Figure 2:
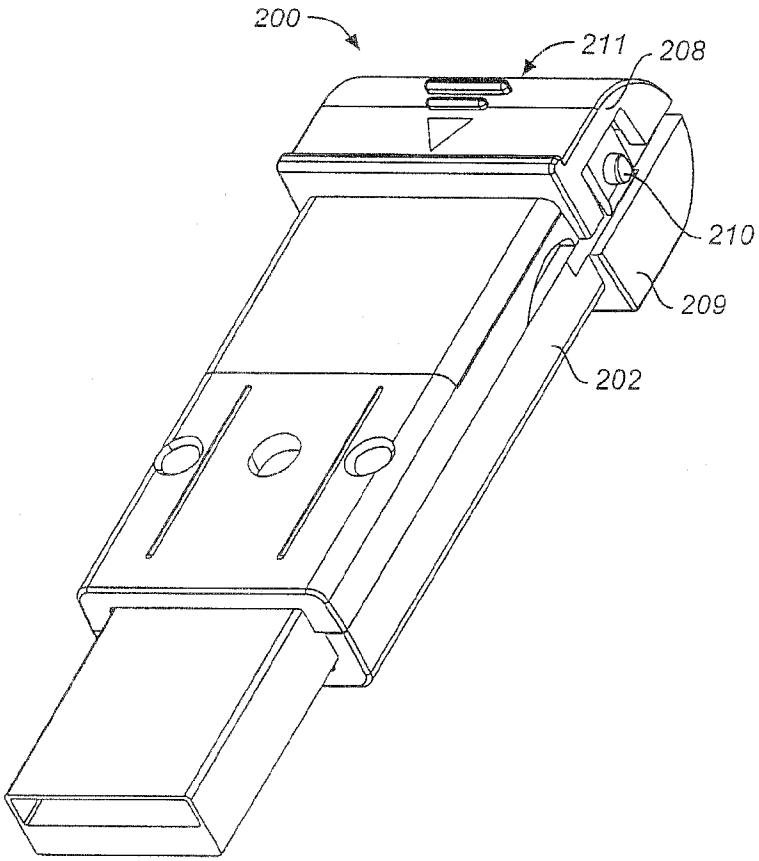
FIG. 2 shows the main body, locking pins, and compression area of a Universal Serial Bus device, according to an embodiment.
Figure 3:
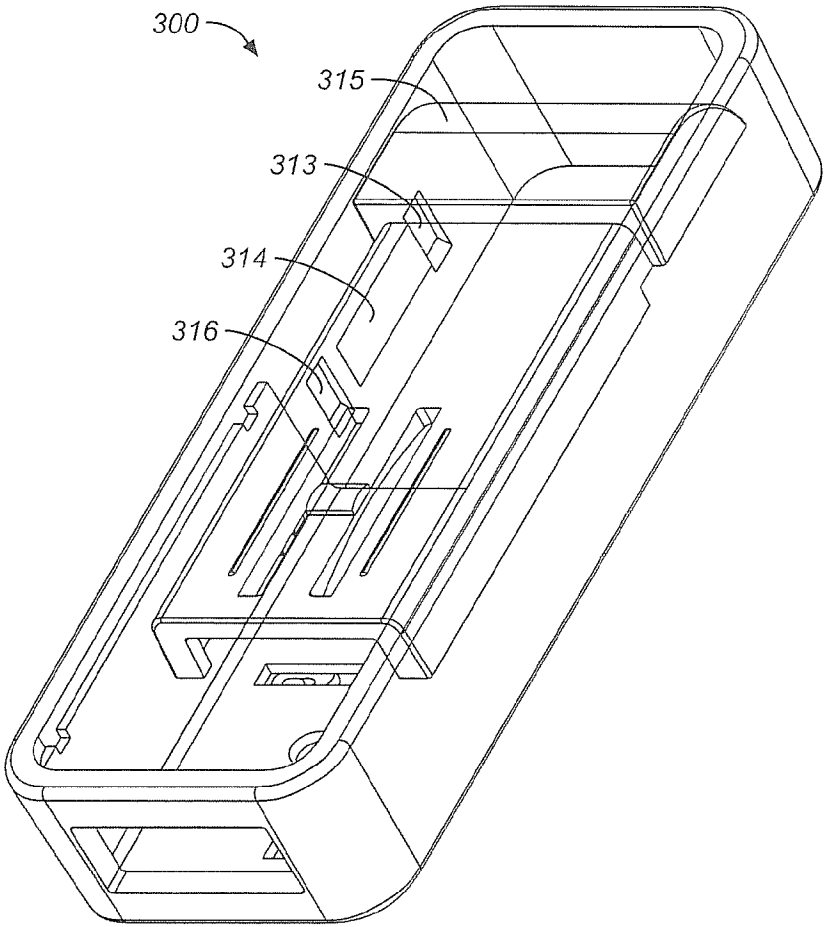
FIG. 3 shows a slot and locking cavities embedded in an inner surface the Universal Serial Bus device casing, according to an embodiment.

FIG. 2 shows a side view of a Universal Serial Bus device 200 showing a second casing 202, upper body 208, lower body 209, slot pin 210, and compression area 211. According to an embodiment, the slide mechanism of a Universal Serial Bus device housing 200 is enabled in the event that a user compresses the Universal Serial Bus device housing 200 along the upper body 208 within compression area 211. For embodiments, vertical compression enables the slide-locking mechanism of Universal Serial Bus device housing 200. Upon compression, slot pin 210 along with another corresponding slot pin disposed on an opposite side of Universal Serial Bus device housing 200, shifts downwards to contact lower body 209 and also inward underneath casing 202 along pin slots embedded in the Universal Serial Bus device 100 as further shown in FIG. 3.

As shown, pin slots 314 are embedded horizontally along an inner surface 315 of Universal Serial Bus device 100. As stated, when the slide-mechanism is enabled a set of slot pins are forced out of their locking positions in the first set of locking cavities 313 and are guided along pin slots 314 to a second set of locking cavities 316. Once the slot pins reach the second set of locking cavities, they are locked in place. That is, when the slot pins are laterally forced from a first set of locking cavities 313 they travel along pin slots 314 until they are locked in a second set of locking cavities 316. The first set of locking cavities 313 may define the retract or extend position for an Universal Serial Bus connector system. Conversely, the second set of locking cavities 316 may define the retract or extend position for a Universal Serial Bus connector system, depending on the defined designation of the first set of locking cavities. For example, if the first set of locking cavities defines a retract position for an Universal Serial Bus connector system when a set of slot pins are locked therein, then the second set of locking cavities defines an extend position for an Universal Serial Bus connector system when a set of slot pins are locked therein.

It can be appreciated that the term "lock", "locking", and other verb tenses of the term refers to fastening, fixing, securing, or holding in place. Accordingly, the slot pins described above are locked, fastened, fixed, secured, or held in place within the locking cavities.

For an embodiment, the distance that the set of slot pins travel to and from the first and second set of cavities defines the length that the connector system can extend or protract beyond the casing (housing or frame) of the Universal Serial Bus device or the distance the connector system can retract or withdraw within. In an embodiment, the connector system extends approximately 12 mm beyond the casing of the Universal Serial Bus device.

For an embodiment, the set of slot pins may feature tapered edges. For an embodiment, "tapered" may be defined as a gradual dimunition of thickness, diameter, or width in an elongated object. For embodiments, the set of slot pins may be tapered to assist the slot pins move within the Universal Serial Bus device once the sliding mechanism is enabled. Additionally, the set of locking cavities may be designed to effectively lock the slot pins in place in the event that the Universal Serial Bus connector system is positioned in a retract or extend state. For an embodiment when the set of slot pins feature tapered edges, the set of slot pins "snap" into place once the slot pins reach the set of locking cavities. Once the slot pins snap in place, the locking cavities provide a tight, flush fit for the slot pins therein.

For an embodiment, the aforementioned procedure defines a first locking mechanism such that a Universal Serial Bus device maintains a static position upon full retraction or extension. For the embodiment, the first locking mechanism is featured along the side of a USB casing.

Figure 4:
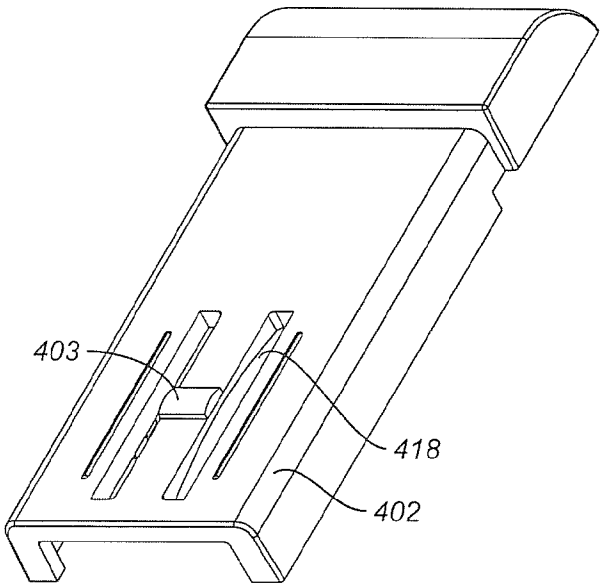
FIG. 4 shows a tab of a secondary latch, according to an embodiment.
Figure 5:
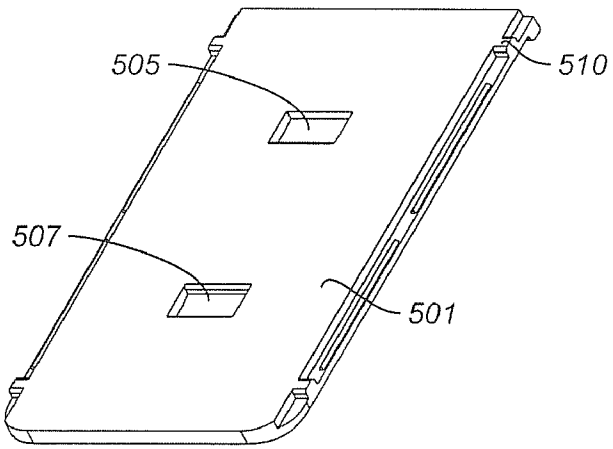
FIG. 5 shows recessed tab cavities for the secondary latch.

The Universal Serial Bus device of the present invention also includes a second locking mechanism shown by FIG. 4 and FIG. 5, according to an embodiment. Accordingly, FIG. 4 shows an inner surface of a Universal Serial Bus device housing 200 (FIG. 2) featuring a tab 403 disposed on a surface of a third casing 402, and a set of guides 418, according to an embodiment. For an embodiment, tab 403 functions as a secondary latch for an Universal Serial Bus device such that tab 403 provides an additional lock when the connector system is set in the retracted or extended position.

For an embodiment, tab 403 comprises a spring section. For the embodiment, the spring section enables the adjustable base to slide along a set of guides embedded along the inner surface of the Universal Serial Bus housing (casing) with minimal resistance. As such, a Universal Serial Bus connector system can extend and retract freely between the first and second locking positions. For the embodiment, tab 403 compresses slightly when the adjustable base slides thereto and therefrom.

For other embodiments, tab 403 also includes tapered edges as shown in FIG. 4. For the embodiment, a tapered tab 403 assists the slot pins move within the Universal Serial Bus device once the sliding mechanism is enabled such that the Universal Serial Bus connector system extends and retracts freely between the first and second locking positions.

FIG. 5 shows a perspective view of a second adjustable base 501 which includes a tab set of slot pins 510 and a set of recessed tab cavities 505, 507 for the secondary latch 403 of FIG. 4, according to an embodiment. In the event that the Universal Serial Bus connector system transitions from a retracted to an extended position, the tab 403 disposed within the Universal Serial Bus device shifts to the corresponding recessed tab cavity. For example, recessed tab cavity 505 may represent the locking position where a Universal Serial Bus connector system is in the extended position Likewise, recessed tab cavity 507 represents the locking position where a Universal Serial Bus connector system is in the retracted position. Accordingly, adjustable base 501 shifts between recessed tab cavity 505 and 507 to extend or retract an Universal Serial Bus connector system. As stated above, tapered tabs having a spring member and tapered slot pins may enable adjustable base 501 to slide within the casing with minimal obstruction, impedance, or resistance.

For an embodiment, the aforementioned procedure defines a secondary locking mechanism. For embodiments, the secondary locking mechanism works in tandem with the first locking mechanism described above. For example, when a USB connector system is fully extended both locking mechanisms are enabled. That is, a set of slot pins are locked within a set of locking cavities and a tab is locked within a tab recess cavity that defines an extended position for the USB connector system. Likewise, a set of slot pins are locked within a set of locking cavities and a tab is locked within a tab recess cavity that defines a retracted position for the USB connector system. Additionally, the secondary locking mechanism is featured along the bottom of the USB casing.

Figure 6:
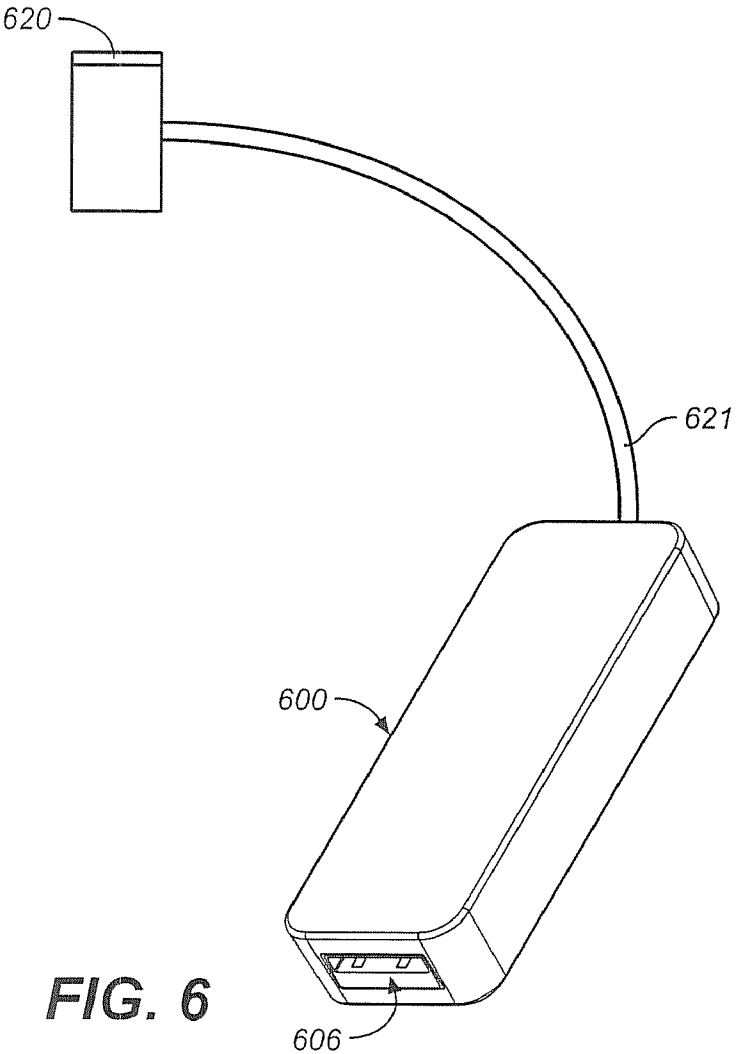
FIG. 6 shows a USB device having a cable, and first and second connectors systems thereto.

Additionally, the Universal Serial Bus device of the present invention may also feature a cable and a second connector system attached thereto such that the USB device can electrically couple to various electronic devices, according to an embodiment. Accordingly, FIG. 6 shows a USB device 600 featuring a first connector system 606, second connector system 620, and a cable 621. For the embodiment, the USB device 600 can be connected to a host computer via first connector system 606 and various other electronic devise by second connector system 620 via cable 621. As such, USB device 600 can be connected to a host computer.

Figure 7:
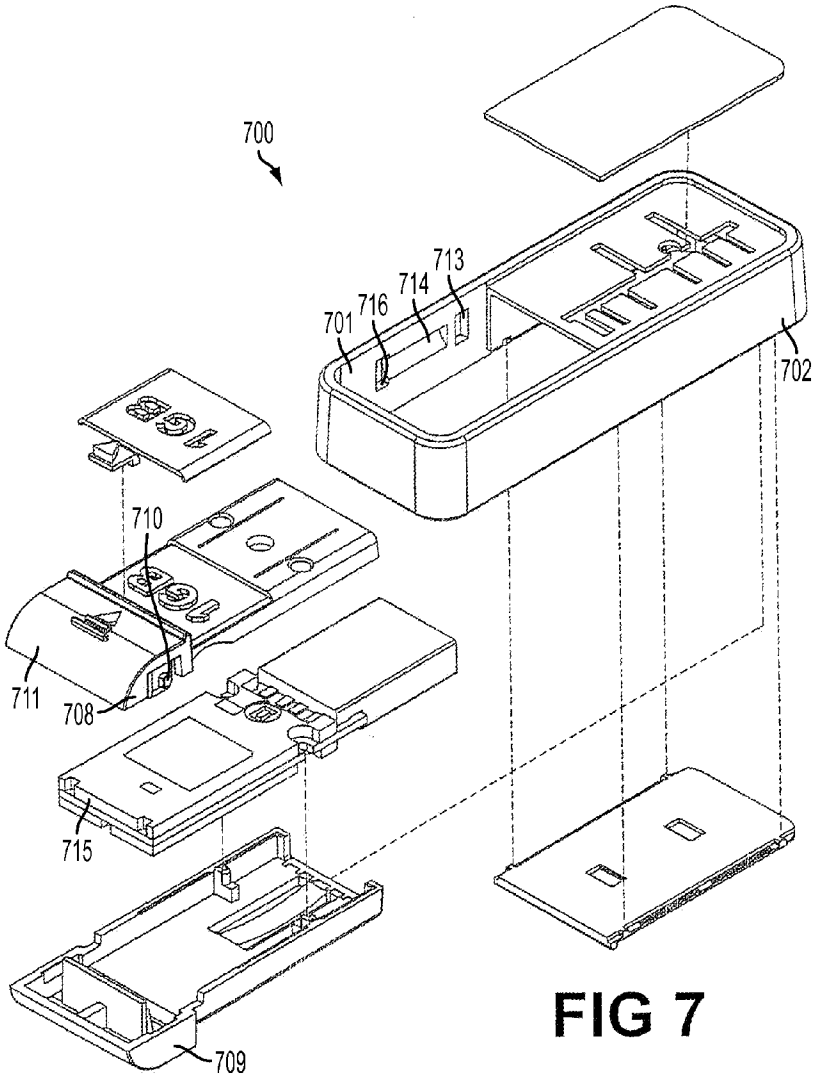
FIG. 7 shows an exploded view of a Universal Serial Bus device that includes a casing design and a connector system that extends and retracts using a multiple side-lock mechanism.

FIG. 7 shows an exploded view of a Universal Serial Bus device 700 that includes a casing design 702 and a connector system that extends and retracts using a multiple side-lock mechanism. As shown, pin slots 714 are embedded horizontally along an inner surface 701 and in between the first set of locking cavities 713 and second set of locking cavities 716. As shown, the side view of Universal Serial Bus device 700 includes a second casing 715, slot pin 710, upper body 708, lower body 709 and compression area 711.

Additionally, it will be appreciated that the USB casing (housing or frame) is waterproof, according to an embodiment. A waterproof casing can protect a USB embedded within mobile products that are exposed to moisture.

It will also be appreciated that a double injection molding process is used to apply alphanumeric characters to an USB casing to ensure that the lettering remains legible.

It will also be appreciated that during assembly a printed circuit board assembly (PCBA) is first cleaned using a degreasing solution and subsequently coated with a membrane thereto in a vacuum environment to ensure the moisture-proof protective casing can be driven under low standoff components.

It will further be appreciated that an USB casing contains a recessed plate to allow co-branding with other products used in conjunction with an USB device.

Although the present invention has been described in accordance with the embodiments shown, one having ordinary skill in the art will readily recognize that there could be variations to the embodiments and those variations would be within the spirit and scope of the present invention. Accordingly, it will be appreciated by one having ordinary skill in the art that the present invention is applicable in general to electronic devices and is therefore not limited to USB devices. Additionally, many modifications may be made by one having ordinary skill in the art without departing from the spirit and scope of the appended claims.

What is claimed is:

1. An apparatus, comprising:
a housing having an adjustable base;
a casing having an upper body and a lower body;
a first tapered slot pin and a second tapered slot pin disposed between the upper body and the lower body;
a first pin slot and a second pin slot, both having a first end and a second end disposed inside of the housing;
a set of guides disposed on a surface of the casing;
a printed circuit board assembly disposed within the casing;
a connector system coupled to the casing; and
a first set of locking cavities coupled to the first ends and a second set of locking cavities coupled to the second ends and wherein when the first and second tapered slot pins are engagingly coupled to one of the set of locking cavities, the connector system is secured to the housing.

2. The apparatus of claim 1, wherein the adjustable base has a plurality of tab cavities adjacent to a tab disposed on the bottom surface of the casing, and wherein the plurality of tab cavities comprises a first tab cavity wherein when the tab is engagingly coupled thereto the connector system is in a retracted position and a second tab cavity wherein when the tab is engagingly coupled thereto the connector system is in an extended position.

3. The apparatus of claim 2, wherein the tab comprises a spring section.

4. The apparatus of claim 2, wherein when the tab is engagingly coupled to one of the plurality of tab cavities, the adjustable base is secured to the casing.

5. The apparatus of claim 1, wherein when the first and second tapered slot pins are engagingly coupled to the first set of locking cavities the connector system is in a retracted position and when the first and second tapered slot pins are engagingly coupled to the second set of locking cavities, the connector system is in an extended position.

6. The apparatus of claim 1, wherein the first set of locking cavities and the second set of locking cavities are first and second locking points and wherein the set tab of cavities is a third locking point.

7. An Universal Serial Bus device, comprising:
a housing having an adjustable base;
a casing having an upper body and a lower body;
a first tapered slot pin and a second tapered slot pin disposed between the upper body and the lower body;
a first pin slot and a second pin slot, both having a first end and a second end disposed inside a of the housing;
a set of guides disposed on a surface of the casing;
a printed circuit board assembly disposed within the casing;
a connector system coupled to the casing; and
a first set of locking cavities coupled to the first ends and a second set of locking cavities coupled to the second ends and wherein when the first and second tapered slot pins are engagingly coupled to one of the set of locking cavities the connector system is in a retracted position and when the first and second tapered slot pins are engagingly coupled to the second set of locking cavities, the connector system is in an extended position.

8. The Universal Serial Bus device of claim 7, wherein the first and second tapered slot pins, first and second pin slots, and first and second locking pin cavities are components of a first locking mechanism.

9. The Universal Serial Bus device of claim 7, wherein the adjustable base has a plurality of tab cavities adjacent to a tab disposed on a surface of the casing and wherein when the tab is engagingly coupled to one of the plurality of tab cavities, the adjustable base is secured to the casing.

10. The Universal Serial Bus device of claim 9, wherein the tab, plurality of tab cavities, and adjustable base are components of a second locking mechanism.

11. An apparatus, comprising:
a cable having a first and a second end, wherein the first end is coupled to a first connector system; and
an apparatus coupled to the second end of the cable, the apparatus comprising: a housing having an adjustable base, a casing having an upper body and a lower body, a first tapered slot pin and a second tapered slot pin disposed between the upper body and the lower body, a first pin slot and a second pin slot, both having a first end and a second end disposed inside of the housing, a set of guides disposed on a surface of the casing, a printed circuit board assembly disposed within the casing, a connector system coupled to the casing, and a first set of locking cavities coupled to the first ends and a second set of locking cavities coupled to the second ends and wherein when the first and second tapered slot pins are engagingly coupled to one of the set of locking cavities, the connector system is secured to the housing.

12. The apparatus of claim 11, wherein the adjustable base has a plurality of tab cavities adjacent to a tab disposed on a surface of the casing and wherein when the tab is engagingly coupled to one of the plurality of tab cavities, the adjustable base is secured to the casing.

* * * * *